US009566502B2

(12) United States Patent
Takagishi et al.

(10) Patent No.: US 9,566,502 B2
(45) Date of Patent: Feb. 14, 2017

(54) BASEBALL GAME BOARD

(71) Applicant: EPOCH COMPANY, LTD., Tokyo (JP)

(72) Inventors: Yoshihiko Takagishi, Katsushika-ku (JP); Nozomu Furuta, Katsushika-ku (JP); Jin Sugiyama, Katsushika-ku (JP)

(73) Assignee: EPOCH COMPANY, LTD., Tokyo (JP)

( * ) Notice: Subject to any disclaimer, the term of this patent is extended or adjusted under 35 U.S.C. 154(b) by 40 days.

(21) Appl. No.: 14/600,350

(22) Filed: Jan. 20, 2015

(65) Prior Publication Data

US 2015/0202527 A1 Jul. 23, 2015

(30) Foreign Application Priority Data

Jan. 21, 2014 (JP) ..... 2014-008676
Dec. 3, 2014 (JP) ..... 2014-245060

(51) Int. Cl.
*A63F 3/00* (2006.01)
*A63F 7/06* (2006.01)

(52) U.S. Cl.
CPC ..... *A63F 7/0608* (2013.01)

(58) Field of Classification Search
CPC ..... A63F 2003/00034; A63F 7/0608; A63F 3/00031
USPC ..... 273/317.6, 317.7, 317.9, 108.3–108.32, 273/129 S, 129 T, 129 V, 129 W, 129 R, 273/119 R
See application file for complete search history.

(56) References Cited

U.S. PATENT DOCUMENTS 1,532,708 A * 4/1925 Moore ..... A63F 7/0608 273/108.31
1,571,726 A * 2/1926 Krug ..... A63F 7/0608 273/108.31
1,994,685 A * 3/1935 Callejas ..... A63F 7/0608 273/108.31
2,511,048 A * 6/1950 Clark ..... A63F 7/0608 273/317.7
4,042,239 A * 8/1977 Cecchetti ..... A63F 7/0684 273/108.52

(Continued)

FOREIGN PATENT DOCUMENTS

JP UM-A-S56-075980 6/1981
JP A-2001-212360 8/2001

(Continued)

*Primary Examiner* — Sebastiano Passaniti
(74) *Attorney, Agent, or Firm* — Drinker Biddle & Reath LLP

(57) ABSTRACT

A baseball game board includes: a top plate; a pitching section including a ball container section and a discharge hole; a batting section; a pitching operation section; and a pitching lever extending from the pitching operation section to the pitching section and movable in forward and rearward directions. The pitching lever is disposed below the top plate, is rotatable in a left-right direction around a position between the pitching operation section and the pitching section, and includes a ball holding section provided at a front end of the pitching lever for receiving a ball dropping from the ball container section. When the pitching lever is moved forward, the ball held in the ball holding section and positioned below the top plate is delivered from the discharge hole to an upper surface of the top plate, thereby being discharged toward the batting section.

4 Claims, 11 Drawing Sheets

(56) References Cited

U.S. PATENT DOCUMENTS 4,216,961 A * 8/1980 McQuillan ..... A63F 7/0608
273/108.31
6,805,348 B1 10/2004 Chen

FOREIGN PATENT DOCUMENTS

JP A-2009-082502 4/2009
JP 2012-152292 A 8/2012

* cited by examiner

BASEBALL GAME BOARD

BACKGROUND

1. Technical Field

Aspects of the present invention relates to a baseball game board on which a baseball games is played, more particularly, to a baseball game board on which pitching and batting are performed by operating tabs.

2. Description of Related Art

There are various kinds of baseball game boards which are configured such that baseball games can be played while pitching, batting, catching, etc. are performed on a board simulating a baseball stadium. This kind of baseball game board is equipped with various kinds of mechanisms, such as a pitching section, a batting section and catching sections, so as to allow figurines representing a pitcher, a batter, runners, fielders, etc. to be placed thereon, whereby the players can enjoy games while applying rules simulating the actual baseball rules.

In JP-A-2012-152292, the applicant has proposed a baseball game board in which a ball can be discharged from the pitching section to the catching section and the discharged ball can be batted at the batting section by operating tabs, and the applicant has provided the baseball game board.

This baseball game board has functions, for example, for causing the discharged ball to curve by operating a magnet provided below the board surface at an intermediate portion between the pitching section and the batting section and for dropping the ball below the board surface by lowering a plate provided immediately in front of the batting section, thereby dropping the ball downward. With these functions, the enjoyment of playing games is increased by changing the path of the pitched ball.

SUMMARY

As described above, the interest of games is enhanced by changing the path of the ball discharged from the pitching section in the conventional baseball game board. However, the ball to be discharged from the pitching section is discharged only in one fixed direction toward the batting section, and the pitching path of the ball is then changed by moving the position of the magnet provided below the board surface, whereby the ball discharged at high speed is hardly subjected to the influence of the magnet and passes a constant strike zone. Hence, once the players are accustomed to the batting operation, the games become uninteresting in some cases.

Aspects of the present invention have been made in view of the above-described circumstances, and an object thereof is to provide a baseball game board on which the players can enjoy interesting baseball games and by performing pitching full of variety while making the operation relatively easy.

An aspect of the present invention provides a baseball game board comprising: a game board body simulating a baseball stadium; a top plate provided on the game board body and comprising a field section; a pitching section provided in a vicinity of a center of the top plate and comprising a ball container section and a discharge hole; a batting section provided in a front portion of the top plate; a batting operation section provided in a front outward portion of the top plate; a pitching operation section provided in a rear outward portion of the top plate; and a pitching lever extending from an inside of the pitching operation section to the pitching section and movable in forward and rearward directions, wherein the pitching lever is disposed below the top plate, is rotatable in a left-right direction in parallel with the top plate around a position between the pitching operation section and the pitching section, and comprises a ball holding section provided at a front end of the pitching lever for receiving a ball dropping from the ball container section, and wherein when the pitching lever is moved forward, the ball held in the ball holding section and positioned below the top plate is delivered from the discharge hole to an upper surface of the top plate, thereby being discharged toward the batting section.

With the above-mentioned aspect, since the discharge direction of the ball is changed in the left-right direction, not only fastball pitching to the center of the strike zone but also fastball pitching to the outside or inside can be performed, whereby the variation width of the pitching can be widened and the players can enjoy more interesting baseball games.

DETAILED DESCRIPTION

First Embodiment

Figure 1:
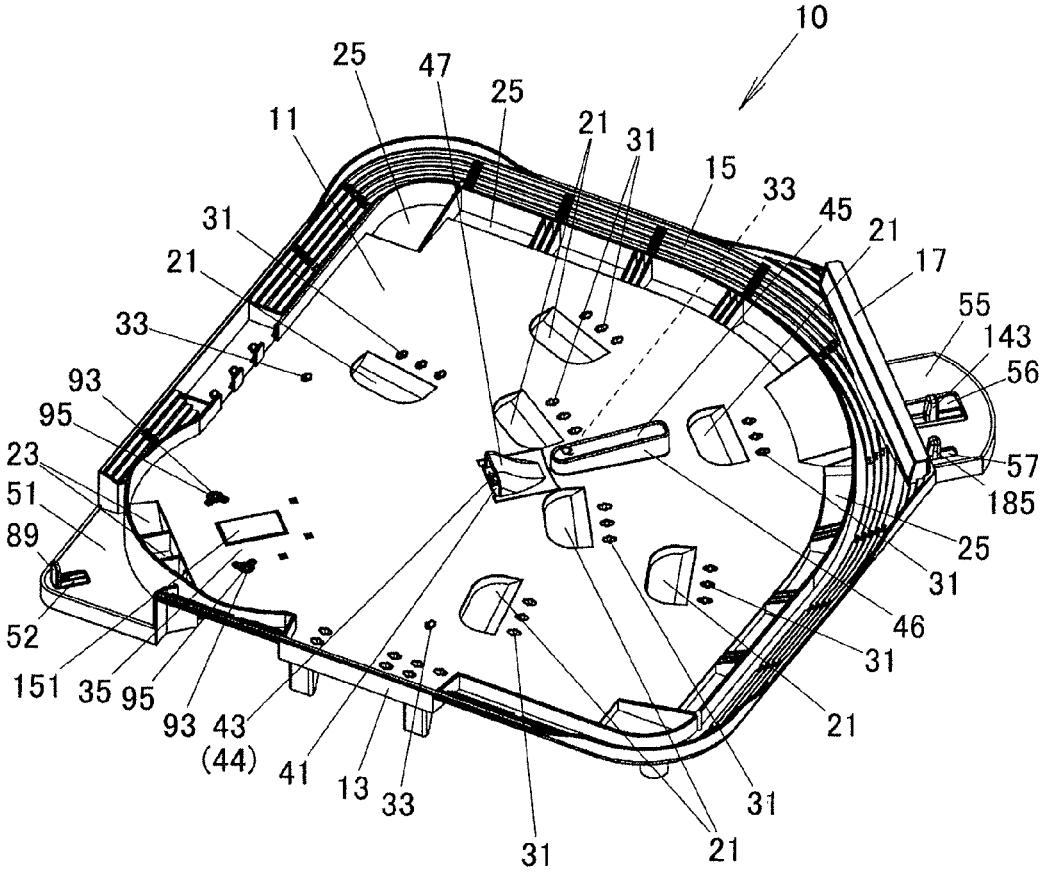
FIG. 1 is a perspective top view showing a baseball game board according to a first embodiment of the present invention.

A baseball game board according to a first embodiment of the present invention includes a game board body 10 simulating a baseball stadium as shown in FIG. 1. The game board body 10 includes a top plate 11 and a main body peripheral wall section 13 provided around the top plate 11 in the up-down direction. The top plate 11 includes a field section provided with a batting section 35 and a pitching section 41, a seat section 15 provided around the field section, a batter's eye screen 17 positioned behind the pitching section 41, etc.

In embodiments according to the present invention, the front-rear direction and the left-right direction are defined as the directions corresponding to the line of sight of the pitcher facing the batting section 35 from the pitching section 41, and the direction of the batting section 35 is assumed to be the forward direction in the following descriptions.

On the top plate 11, dents are formed as three ball catching sections 23 in front of the batting section 35. If a discharged ball entered the center dent, the pitch is judged as a "strike", and if the ball entered the left or right dent, the pitch is judged as a "ball".

On the top plate 11, dents are also formed as fielder ball catching sections 21 at the fielder positions of the first base, second base, third base, shortstop, center field, right field and left field on the field section. If a batted ball entered one of the fielder ball catching sections 21, it is assumed that the batter is "out".

Three holes are provided behind each of the fielder ball catching sections 21 as fielder standing sections 31, whereby a figurine representing a fielder is inserted into and fixed to the holes.

On the top plate 11, a plurality of dents are formed as receiving sections 25 in the field section immediately in front of the right field stands and the left field stands along the seat section 15. If a batted ball entered the receiving section 25 positioned in a foul territory, it is judged that the batter hits a "foul", and if a batted ball entered the receiving section 25 positioned in a fair territory, it is appropriately judged that the batter is "out" or the batter hits a "single", "double" or "triple".

On the top plate 11, holes are provided as runner standing sections 33 at the positions corresponding to the first, second and third bases of the field section, respectively, whereby a figurine representing a runner can be inserted into the hole.

Besides, on the top plate 11, the batting section 35 is provided at the home plate position of the field section. A home plate (not shown) is illustrated on the batting section 35, and a movable plate 151 is disposed behind the home plate.

On the upper surface of the top plate 11, the upper ends of rotation shafts 93 (described later) are exposed on the left and right sides of the home plate. A simulated bat or a batter figurine having a simulated bat (not shown) is inserted in the rotation hole 95 provided at the center of this rotation shaft 93, and the simulated bat is made rotatable.

In the vicinity of the center of the top plate 11, the pitching section 41 is provided. At the pitching section 41, a discharge hole 44 for discharging a ball is formed in the top plate 11. The discharge hole 44 forms a discharge section 43. Furthermore, at the pitching section 41, a discharge cover 47 for covering the discharge hole 44, a discharge mechanism (described later) disposed below the top plate 11, and a ball container section 45 disposed behind the discharge cover 47 are provided.

The ball container section 45 includes a peripheral wall section 46 upstanding on the upper surface of the top plate 11, and a plurality of balls can be surrounded by the peripheral wall section 46. The bottom portion of the ball container section 45 is formed into an inclined surface, whereby a ball can drop downward below the top plate 11 from the ball feeding hole provided inside the ball container section 45.

Furthermore, behind the batter's eye screen 17, a pitching operation section 55 having a height lower than the height of the top plate 11 is formed outside the top plate 11. In the pitching operation section 55, a pitching tab 143 and a breaking ball tab 185 are disposed. In front of the ball catching sections 23, a batting operation section 51 having a height lower than the height of the top plate 11 is formed outside the top plate 11. In the batting operation section 51, a batting tab 89 is disposed.

The batting tab 89 is formed at the tip end of the batting arm 81 of a batting mechanism (described later) and protrudes upward above the batting operation section 51 from a batting operation hole 52. The pitching tab 143 is formed at the rear end of the pitching lever 131 of a pitching mechanism (described later) and protrudes upward above the pitching operation section 55 from a pitching operation hole 56. The breaking ball tab 185 is formed at the rear end of a breaking ball lever 181 and protrudes upward above the pitching operation section 55 from a breaking ball operation hole 57.

The batting operation hole 52 and the breaking ball operation hole 57 are formed into slots being long in the front-rear directions of the batting tab 89 and the breaking ball tab 185 so that the batting tab 89 and the breaking ball tab 185 can move only in the front-rear direction. The pitching operation hole 56 is formed into a slot being long in the front-rear direction of the pitching tab 143 and being wide in the left-right direction thereof so that the pitching tab 143 can move in the front-rear direction and the left-right direction.

Figure 2:
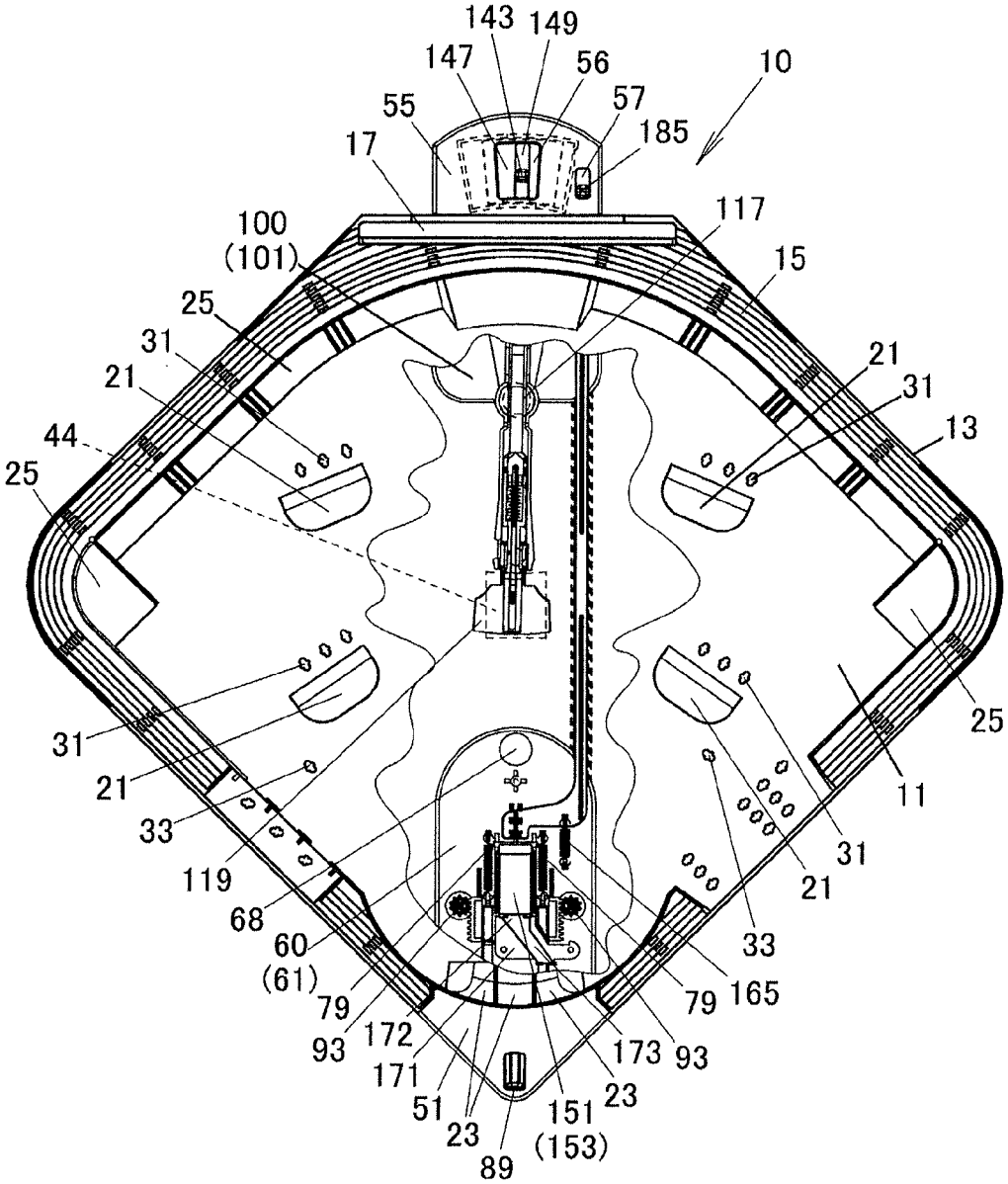
FIG. 2 is a partial cross-sectional top view showing the baseball game board according to the first embodiment of the present invention.
Figure 3:
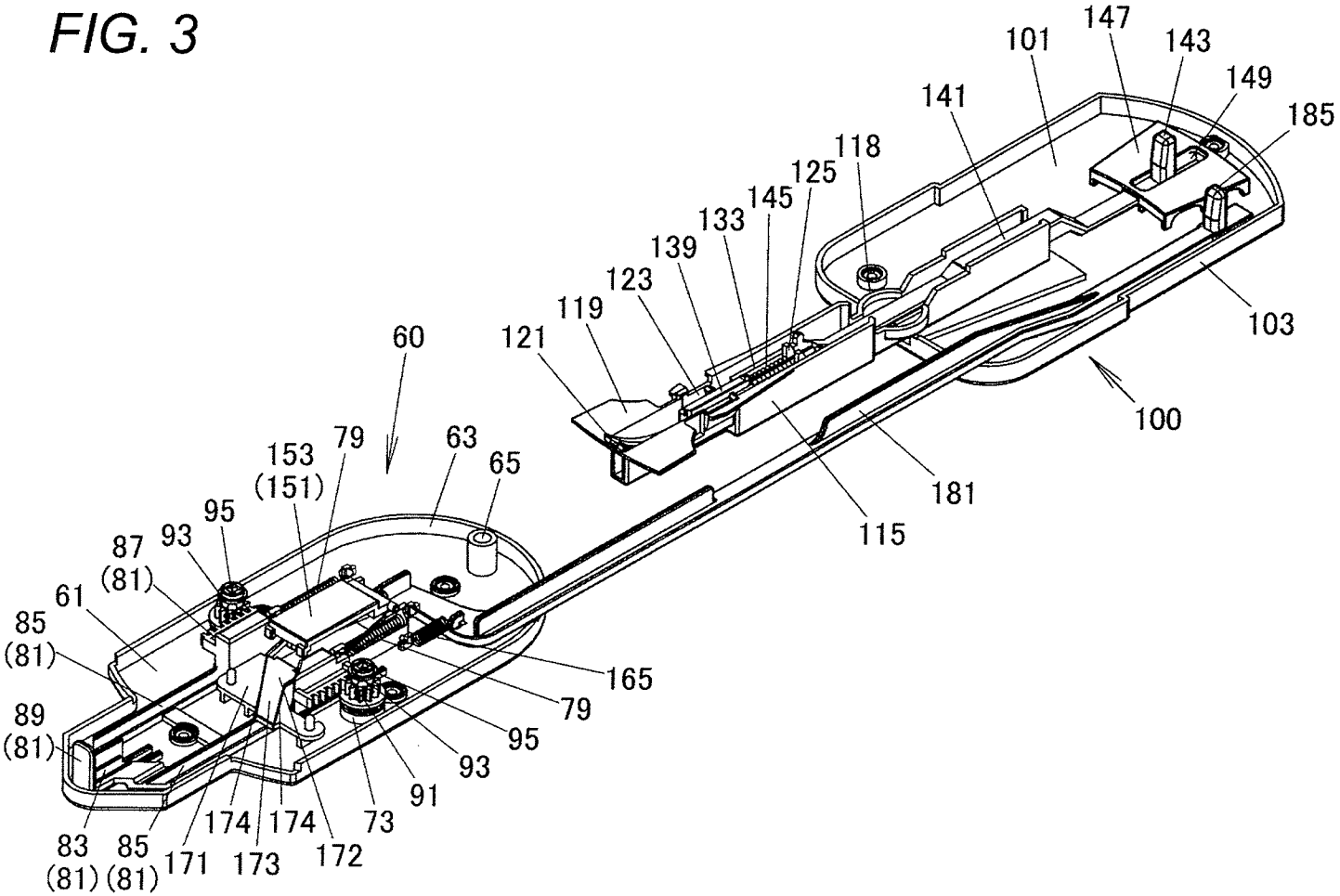
FIG. 3 is a view showing the batting mechanism and the pitching mechanism of the baseball game board according to the first embodiment of the present invention.

The batting mechanism is disposed below the top plate 11 in the area ranging from the lower side of the batting operation section 51 to the lower side of the batting section 35 as shown in FIGS. 2 and 3. Furthermore, the batting mechanism is accommodated in a batting mechanism cover 60 provided so as to cover the rear surface of the top plate 11 up to the lower side of the intermediate portion between the batting section 35 and the pitching section 41.

Figure 4:
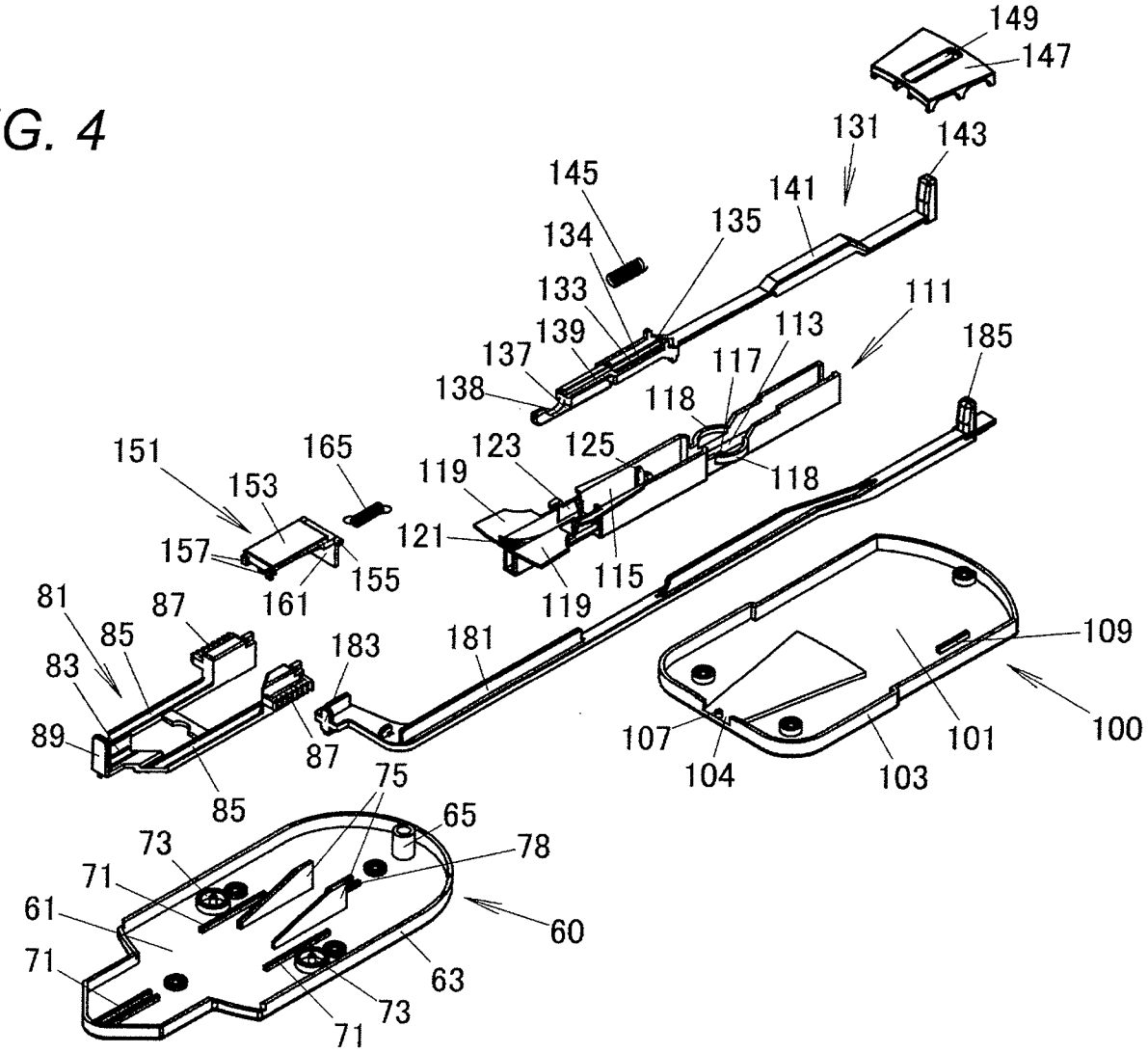
FIG. 4 is an exploded view showing the batting mechanism and the pitching mechanism of the baseball game board according to the first embodiment of the present invention.

The batting mechanism cover 60 protrudes forward and extends in width in the left-right direction so as to cover the lower side of the ball catching sections 23 as shown in FIG. 4. The length of the batting mechanism cover 60 is the length up to the intermediate portion between the batting section 35 and the pitching section 41. The front end of the batting mechanism cover 60 is formed into a triangular shape so as to be matched with the corner section of the game board body 10, and the rear end of the batting mechanism cover 60 is formed into a circular arc shape. Moreover, the batting mechanism cover 60 has a flat bottom plate 61 and a peripheral wall 63 extending upward along the periphery of this bottom plate 61.

In the vicinity of the rear end of the bottom plate 61, the batting mechanism cover 60 includes a magnet holding section 65 for holding a magnet 68 that is secured to the lower surface of the top plate 11 located on the line connecting the discharge hole 44 to the center of the home plate at the intermediate portion between the pitching section 41 and the batting section 35. The magnet holding section 65 protrudes upward.

The batting mechanism cover 60 includes: two rod-shaped operation lever regulating sections 78 in front of the magnet holding section 65 and extending in the front-rear direction so as to form a groove therebetween in the front-rear direction; plate support sections 75 provided in the vicinity of the center of the bottom plate 61 in the left-right direction for supporting the flat plate section 153 of the movable plate 151 at the height of the top plate 11; and rod-shaped arm guide sections 71 provided in the vicinity of the front end section of the bottom plate 61 and extending in the front-rear direction on the left and right outsides of the plate support section 75. The arm guide sections 71 holds the batting arm 81 in the left-right direction by, whereby the batting arm 81 is supported so as to be slidable in the front-rear direction.

The batting mechanism cover 60 includes rotation bearing sections 73 on the further left and right outsides of the arm guide sections 71 that are provided on the left and right outsides of the plate support sections 75 provided in the vicinity of the center of the bottom plate 61. The lower ends of the rotation shafts 93 are rotatably supported by the rotation bearing sections 73.

The batting arm 81 includes: a rod-shaped base body section 83 provided on a front portion thereof and extending in the front-rear direction; the batting tab 89 extending upward from the front end of the base body section 83; two rod-shaped parallel body sections 85 extending rearward from the rear end of the base body section 83 and disposed in parallel with each other with a gap provided therebetween in the left-right direction; and rack sections 87 provided on the outside surfaces of the parallel body sections 85.

The batting arm 81 is regulated such that both the sides of the base body section 83 are held between the arm guide sections 71 provided in the vicinity of the front end of the bottom plate 61 and such that both the outsides of the parallel body sections 85 are held between the arm guide sections 71 provided in the vicinity of the center of the bottom plate 61 in the left-right direction. The batting arm 81 is urged toward the rear side of the batting mechanism cover 60 by a batting spring 79 disposed at the rear end of the parallel body sections 85 as shown in FIGS. 2 and 3.

Hence, in a state in which the upper end of the batting tab 89 extending upward from the front end of the base body section 83 protrudes upward above the batting operation section 51 from the batting operation hole 52 of the batting operation section 51, when the batting tab 89 is moved forward with the tip of a finger and when the finger is released from the batting tab 89 in a state in which the batting tab 89 is extended, the batting arm 81 is moved quickly to the rear side of the game board body 10 by the batting spring 79.

The rotation shafts 93 are installed in the rotation bearing sections 73 that are disposed outside the arm guide sections 71 provided at the center of the bottom plate 61 in the left-right direction and positioned outside the parallel body sections 85 of the batting arm 81 as shown in FIGS. 2 and 3.

The rotation shafts 93 are supported by the rotation bearing sections 73 so as to be rotatable in the horizontal direction while the axial center line of each shaft is oriented in the up-down direction. Each rotation shaft 93 has a pinion section 91 meshing with the rack section 87 provided on the batting arm 81 and has the rotation hole 95 at the center of the upper end of the rotation shaft 93. The upper end of the rotation shaft 93 is exposed to the upper surface of the top plate 11.

The angle of the rotation shaft 93 rotated by the front-rear movement of the batting arm 81 is approximately 150 to 180 degrees.

The movable plate 151 constituting a breaking ball mechanism is accommodated inside the batting mechanism cover 60.

The movable plate 151 includes: the flat plate section 153 having a rectangular flat plate shape; and a protruding shaft section 155 protruding outside from the rear end of the flat plate section 153 in the left-right direction as shown in FIG. 4. The movable plate 151 is supported via the shaft section 155 by the plate support sections 75 provided on the bottom plate 61 such that the front end of the flat plate section 153 is rotatable in the up-down direction around the shaft section 155.

In addition, when the flat plate section 153 is parallel to the bottom plate 61 and is horizontal, the upper surface of the flat plate section 153 is flush with the upper surface of the top plate 11. The flat plate section 153 has the same size as that of the rectangular hole provided in the top plate 11, and part of the top plate 11 is formed of the flat plate section 153. In the batting section 35, a ball can be dropped below the top plate 11 by operating the breaking ball tab 185.

The front end of the flat plate section 153 has engagement sections 157 slightly protruding forward at positions lower than the upper surface of the flat plate section 153. Since the engagement sections 157 contact the lower surface of the top plate 11, the front end of the flat plate section 153 is prevented from rotating upward above the top plate 11.

The movable plate 151 further includes a plate-shaped hanging section 161 extending downward from the rear end of the flat plate section 153. A pressing section 183, that is, the front end of the breaking ball lever 181, contacts the rear surface of the hanging section 161.

The breaking ball lever 181 has an elongated rod shape, and the front end section thereof and the portion in the vicinity of the front end section are accommodated inside the batting mechanism cover 60. The breaking ball lever 181 is urged forward by a plate holding spring 165 as shown in FIG. 3. The lower portion of the hanging section 161 is pressed forward by making the pressing section 183, that is, the front end of the breaking ball lever 181, in contact with the rear surface of the hanging section 161 of the movable plate 151.

The lower portion of the pressing section 183, that is, the tip end of the breaking ball lever 181, is held between the operation lever regulating sections 78 that are provided on the bottom plate 61 of the batting mechanism cover 60 so as to form a groove therebetween in the front-rear direction, whereby the pressing section 183 is restricted from moving in the left-right direction and can move only in the front-rear direction.

With the above-mentioned configuration, the lower end of the hanging section 161 is pressed forward by the front end of the breaking ball lever 181, whereby the upper surface of the flat plate section 153 is usually flush with the upper surface of the top plate 11. However, when the breaking ball lever 181 is retreated, the flat plate section 153 is rotated by its own weight such that the front end thereof is lowered.

Then, when the front end of the flat plate section 153 is lowered, the lowered front end contacts a guide member 171.

The guide member 171 has a guide path 173 equipped with an entrance section 172 having a width matched with the width of the flat plate section 153 as shown in FIGS. 2 and 3. Since step sections 174 are formed on both side of the guide path 173, a ball rolls along the guide path 173. The guide path 173 guides a ball to the left ball catching section 23 of the three ball catching sections 23, that is, the ball catching section 23 wherein the pitch is called "ball."

The rear end portion of the breaking ball lever 181 and in the vicinity thereof is accommodated in a pitching operation section cover 100. The breaking ball tab 185 extending upward in the vicinity of the rear end of the breaking ball lever 181 protrudes upward above the pitching operation section 55 from the breaking ball operation hole 57 of the pitching operation section 55.

The pitching operation section cover 100 has the same lateral width as that of the pitching operation section 55. The pitching operation section cover 100 includes: a bottom plate 101 having a substantially rectangular shape and having a length extending in the front-rear direction from the pitching operation section 55 to the intermediate portion between the pitching operation section 55 and the pitching section 41; and a peripheral wall 103 extending upward around this bottom plate 101. The pitching operation section cover 100 is a cover for covering the back surface of the top plate 11 ranging from the pitching operation section 55 to the intermediate portion between the pitching operation section 55 and the pitching section 41, thereby accommodating the rear end of the breaking ball lever 181 and in the vicinity thereof, the rear end portion of a pitching lever holder 111 and the rear end portion of the pitching lever 131.

On a side of the intermediate portion of the bottom plate 101, an operation lever regulating protrusion 109 having a slight length in the front-rear direction is provided. Since the operation lever regulating protrusion 109 is inserted into the groove provided in the lower surface at the portion in the vicinity of the rear end of the breaking ball lever 181, the breaking ball lever 181 can move only in the front-rear direction.

At a portion of the peripheral wall 103 corresponding to the central portion of the front end of the bottom plate 101, a cutout portion 104, having a wider upper portion and a slightly narrower lower portion with step portions provided therebetween, is provided. In the central portion in the vicinity of the front end of the bottom plate 101, a cylindrical rotation bearing 107 is provided.

The pitching mechanism supported by the rotation bearing 107 includes the pitching lever 131 having an elongated rod shape and the pitching lever holder 111 for holding the pitching lever 131. The pitching lever 131 is formed so as to have the length ranging from the inside of the pitching operation section 55 to the position below the pitching section 41.

Figure 5:
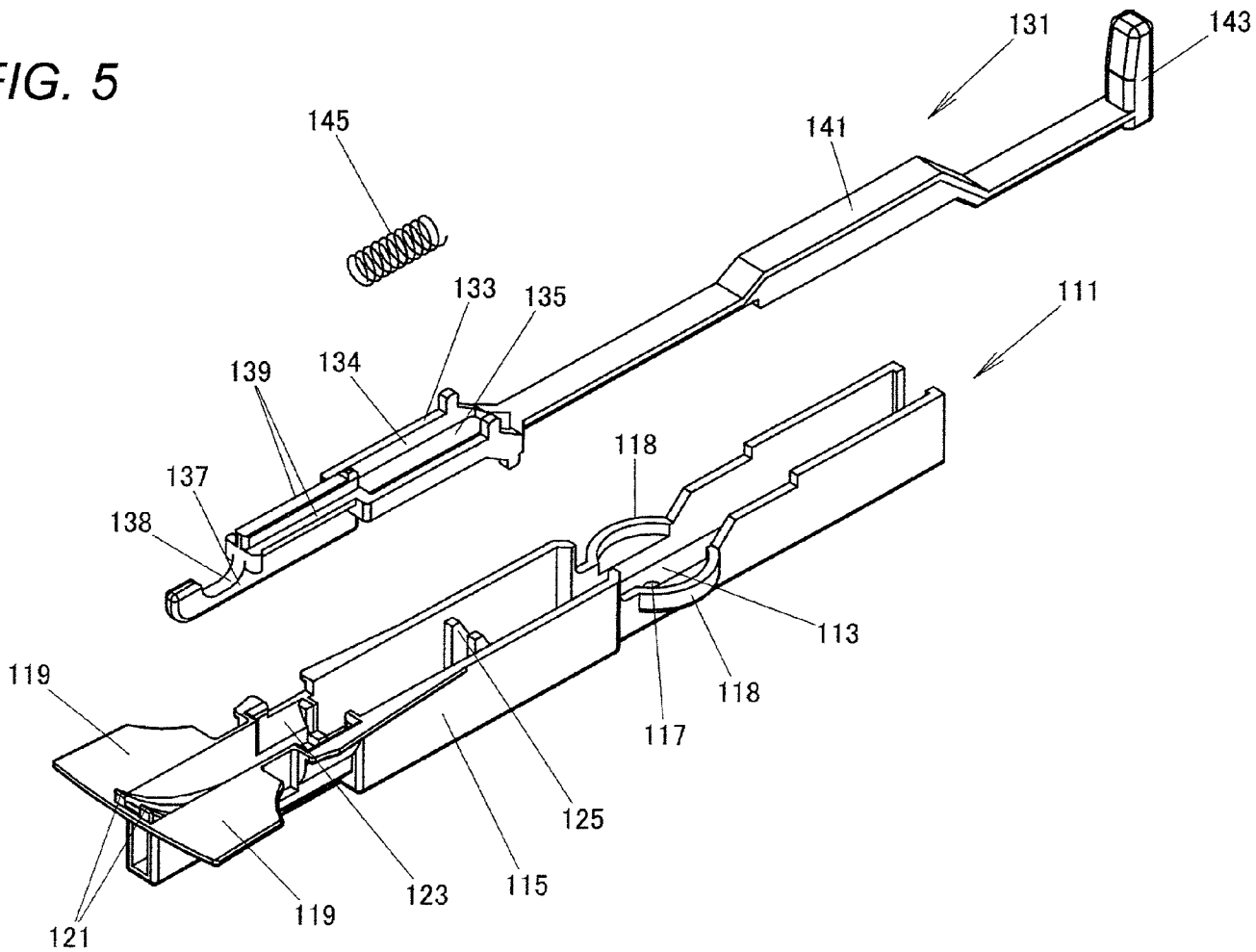
FIG. 5 is an exploded view showing the main sections of the pitching section of the baseball game board according to the first embodiment of the present invention.

The pitching lever holder 111 has a bottom section 113 having an elongated plate shape and side wall sections 115 having an elongated plate shape and extending upward on both the left and right sides of the bottom section 113 as shown in FIGS. 4 and 5. By the bottom section 113 and the side wall sections 115 provided on the left and right sides of the bottom section 113, the pitching lever 131 having an elongated rod shape is held, whereby the pitching lever 131 is movable only in the front-rear direction.

The height of the side wall sections 115 is slightly larger than the diameter of a ball 189 and the clearance between the left and right side wall sections 115 is substantially equal to the diameter of the ball 189, whereby the ball 189 can be accommodated inside the pitching lever holder 111 together with the pitching lever 131.

The pitching lever holder 111 has a rotation shaft hole 117 disposed slightly behind the center of the bottom section 113. The pitching lever holder 111 is mounted on the rotation bearing 107 provided on the pitching operation section cover 100 by virtue of this rotation shaft hole 117, thereby being rotatable in the range of approximately 5 degrees in each of the left and right directions from a neutral position in which the pitching lever holder and the pitching lever 131 are oriented along the front-rear direction (toward the center of the home plate).

Flange sections 118 protruding to both the outer sides from the side wall sections 115 in a circular arc shape are provided so as to form a circle having its center at the rotation shaft hole 117. In a state in which the flange sections 118 are placed on the step sections of the cutout portion 104 provided at the central portion of the front end in the peripheral wall 103 of the pitching operation section cover 100, the pitching lever holder 111 is inserted in the cutout portion 104, whereby the rotation of the pitching lever holder 111 is stabilized.

The pitching lever holder 111 includes inclined sections 121 in the vicinity of the front end of the bottom section 113. Each of the inclined section 121 is gently curved upward from the bottom section 113 and has a tip end slightly higher than the side wall section 115 at its front portion. This tip end has a height close to the height of the upper surface of the top plate 11 and is placed in the discharge hole 44 of the top plate 11.

The inclined sections 121 are formed along the left and right side wall sections 115 while having a groove extending in the front-rear direction along the axial line of the pitching lever holder 111 and at the center between the inclined sections 121. The tip end protrusion 137 of the pitching lever 131 (described later) can be inserted into this groove.

At the front ends of the side wall sections 115, cover plates 119 respectively expanding to the left and right from the upper ends of the side wall sections 115 are provided. The discharge hole 44 has a width in the left-right direction wider than the width between the left and right side wall sections 115. However, openings formed outside the side wall sections 115 in the discharge hole 44 are closed with the cover plates 119, whereby even if the front end of the pitching lever holder 111 is moved in the left-right direction below the discharge hole 44, no opening is formed at the discharge hole 44 on the outer sides of the side wall sections 115.

The pitching lever holder 111 includes a ball receiving section 123 slightly behind the rear ends of the cover plates 119. The ball receiving section 123 is formed by expanding the upper portions of the left and right side wall sections 115 in the left and right directions so as to increase the width of the interval between the upper portions of the left and right side wall sections 115.

The ball receiving section 123 is disposed below a ball feeding hole 49 (see FIGS. 6A to 6D) which is formed as a through hole provided at the front end of the ball container section 45 of the top plate 11. With the ball receiving section 123, even in the case that the front end of the pitching lever holder 111 is moved in the left-right direction around the center of the rotation shaft hole 117 of the pitching lever holder 111, the ball 189 from the ball filling hole 49 can drop securely between the left and right side wall sections 115.

The pitching lever holder 111 includes a spring receiving section 125 formed of two rod-shaped members protruding from the bottom section 113 behind the ball receiving section 123. The spring receiving section 125 holds the rear end of a pitching spring 145 for urging the pitching lever 131 forward.

At the portion in the vicinity of the front end of the pitching lever 131, a pitching body section 133 having a rectangular parallelepiped shape is formed as shown in FIGS. 4 and 5. The left-right width of the pitching body section 133 is substantially equal to the diameter of the ball 189.

The pitching body section 133 includes a spring storing section 134 that is formed of a groove hole. The groove hole extends along the axial direction of the pitching lever 131 and penetrates the pitching body section 133 from its upper surface to its lower surface. The groove hole has a length in the front-rear direction substantially equal to the length of the pitching spring 145 when the pitching spring 145 is extended. The pitching body section 133 includes a rod-shaped spring holding section 135 provided inside the spring storing section 134. The spring holding section 135 extends from the front end wall of the spring storing section 134 to a portion close to the rear end wall of the spring storing section 134.

The spring holding section 135 penetrates through the pitching spring 145 having a spiral shape, and the rear end of the spring holding section 135 is inserted into the space between the two rod-shaped members serving as the spring receiving sections 125 provided at the bottom section 113 of the pitching lever holder 111. The front end of the pitching spring 145 contacts the front end wall of the spring storing section 134, and the rear end of the pitching spring 145 contacts the spring receiving sections 125, whereby the pitching spring 145 is held in a slightly compressed state.

The pitching lever 131 includes: the plate-shaped tip end protrusion 137 protruding forward from the central portion of the front end of the pitching body section 133; and a ball holding section 138 formed by cutting the tip end protrusion 137 from above in a U-shape at the intermediate portion of the tip end protrusion 137 in the front-rear direction.

The tip end protrusion 137 has a height larger than the diameter of the ball, and the height of the tip end protrusion 137 at the portion in front of the ball holding section 138 is reduced.

The pitching lever 131 includes plate-shaped hole closing sections 139 slightly protruding in the left-right direction from the vicinity of the upper end of the tip end protrusion 137 behind the ball holding section 138. The upper surfaces of the hole closing sections 139 have the same height as that of the upper surface of the pitching body section 133, and the upper end surface of the tip end protrusion 137 is slightly higher than the upper surface of the pitching body section 133.

The upper end surface of the tip end protrusion 137 slightly contacts the back surface of the top plate 11, whereby the lower side of the ball feeding hole 49 can be closed by the upper end surface of the tip end protrusion 137 and the hole closing sections 139.

The tip end protrusion 137 has a thickness in the left-right direction, which can be inserted into the groove formed to extend in the front-rear direction and provided at the center between the inclined sections 121 provided at the front end of the pitching lever holder 111.

The pitching lever 131 includes: a connection section 141 extending rearward from the pitching body section 133; and the pitching tab 143 extending upward from the rear end of the connection section 141.

The pitching tab 143 passes through the tab insertion hole 149 of a tab protection plate 147 having a fan shape, whereby the upper end of the pitching tab 143 protrudes upward from the pitching operation hole 56 of the pitching operation section 55.

The tab insertion hole 149 provided in the tab protection plate 147 is a slot having its major axis in the front-rear direction and is movable in the left-right direction together with the pitching tab 143 provided at the rear end of the pitching lever 131. On the other hand, the movement of the tab insertion hole 149 in the front-rear direction is restricted by the protruding section provided on the back side of the top plate of the pitching operation section 55. The tab protection plate 147 closes the clearances at the left and right portions of the pitching lever 131 generated in the pitching operation hole 56 in which the pitching tab 143 is movable in the front-rear direction and in the left-right direction.

Hence, even if the rear end of the pitching lever 131 is moved in the left-right direction, the pitching tab 143 can be moved in the front-rear direction along the tab insertion hole 149 while the clearances generated at the left and right portions of the pitching lever 131 in the pitching operation hole 56 are closed with the tab protection plate 147.

Figure 6A:
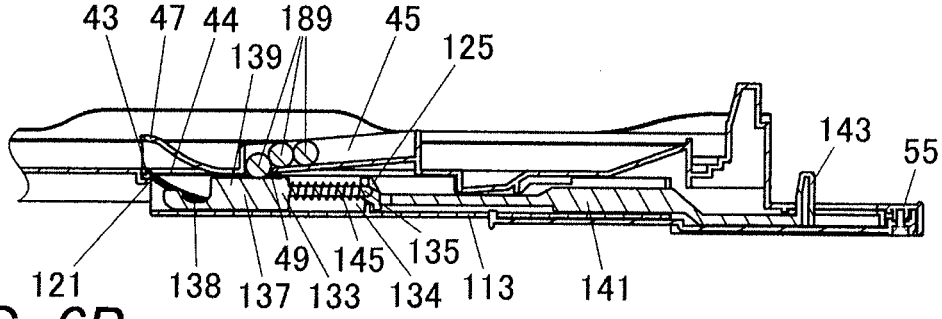
FIGS. 6A to 6D are views showing the ball discharge operation of the baseball game board according to the first embodiment of the present invention.
Figure 6B:
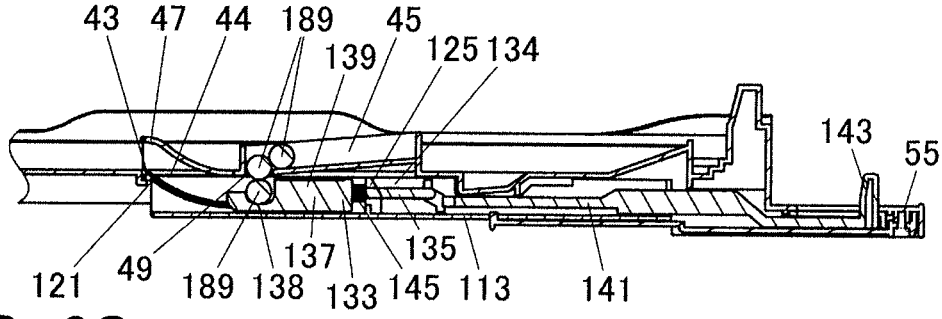

In the baseball game board equipped with this pitching mechanism, FIG. 6A shows a state in which the pitching lever 131 is positioned in a front portion of the pitching lever holder 111 such that the upper end surface in the vicinity of the rear portion of the tip end protrusion 137 and the hole closing sections 139 close the ball feeding hole 49. At first, the pitching lever 131 in a state shown in FIG. 6A is moved rearward so as to further compress the pitching spring 145 by operating the pitching tab 143 with a finger. Next, as shown in FIG. 6B, when the pitching body section 133 is retreated such that the ball holding section 138 is positioned below the ball feeding hole 49, the ball 189 drops from the ball feeding hole 49 to the ball holding section 138.

At this time, since the width of the ball receiving section 123 of the pitching lever holder 111 is made wider than the diameter of the ball 189 by widening the upper portions of the side wall sections 115 in the left-right direction, the ball 189 can be made to drop securely to the gap between the left and right side wall sections 115 of the pitching lever holder 111. Furthermore, although the upper portions of the ball receiving section 132 are widened in the left-right direction, since the width between the lower portions thereof coincides with the width of the side wall sections 115 adapted to the diameter of the ball 189, the ball 189 having dropped to the ball receiving section 123 can be regulated securely in the left-right direction by the side wall sections 115.

The ball 189 having dropped is held in the ball holding section 138 formed at the tip end protrusion 137 provided in front of the pitching body section 133 of the pitching lever 131. Then, the rear side of the ball 189 having dropped is restricted by the rear rising portion of the ball holding section 138, and is accommodated in the hemispheric portion formed at the lower end of the ball holding section 138, whereby the position of the ball 189 is determined which the movement thereof in the front-rear direction is also restricted securely, and the next ball 189 is prevented from dropping from the ball feeding hole 49.

Figure 6C:
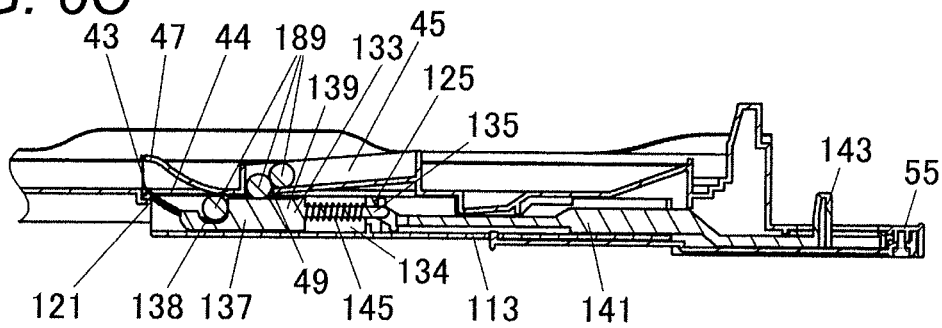

Next, as shown in FIG. 6C, when the position of the pitching tab 143 is adjusted so as to slightly move the pitching lever 131 forward, the lower side of the ball feeding hole 49 is closed by the upper end surface of the tip end protrusion 137 and the hole closing sections 139, only one ball 189 is held in the ball holding section 138, and the compression state of the pitching spring 145 can be adjusted by adjusting the front-rear position of the pitching lever 131.

Figure 6D:
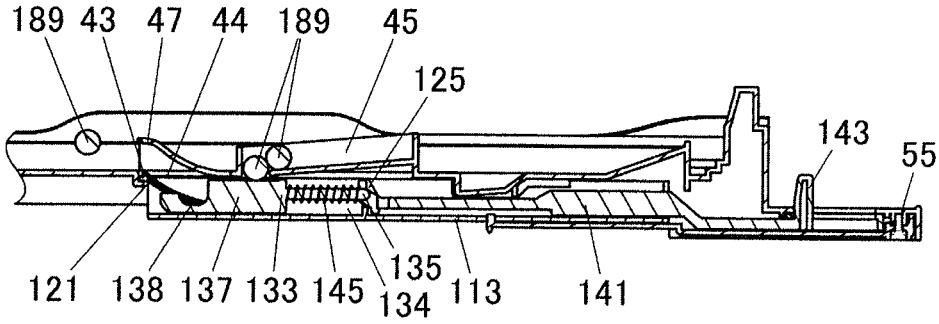

After the front-rear position of the pitching lever 131 is adjusted by adjusting the position of the pitching tab 143 as described above, when the finger is released from the pitching tab 143, the pitching lever 131 is moved forward by the resilient force of the compressed pitching spring 145, and the tip end protrusion 137 having the ball holding section 138 is inserted into the groove between the inclined sections 121 as shown in FIG. 6D.

Hence, the ball 189 being held by the ball holding section 138 is raised along the inclined sections 121 and delivered so as to jump out from the discharge hole 44 to the upper surface of the top plate 11 and makes contact with the inner surface of the discharge cover 47, whereby the ball is discharged while rolling along the top plate 11 from the pitching section 41 toward the batting section 35.

Furthermore, since the pitching lever 131 is rotatable, together with the pitching lever holder 111, around the rotation shaft hole 117 located at the intermediate portion between the pitching operation section 55 and the pitching section 41 only by approximately five degrees in each of the left and right directions with respect to the axial line in the direction from the pitching section 41 to the center of the home plate illustrated on the batting section 35, the discharge direction of the ball 189 is not limited to a direction toward the center of the home plate, but the ball 189 can be discharged in directions slightly away from the center of the home plate in the left-right direction.

The magnet 68 is fixed to the back surface of the top plate 11 in the vicinity of the intermediate position between the pitching section 41 and the batting section 35. The ball 189 discharged toward the center of the home plate passes just above the magnet 68 and goes straight. In contrast, the ball 189 discharged in a direction toward slightly away from the center in the left-right direction passes a position slightly shifted from the center of the magnet 68, and the traveling path of the ball 189 is bent by the magnet 68.

If the discharge speed is low, the influence of the magnet 68 is significant, and if the discharge speed is high, the influence of the magnet 68 becomes weak. Hence, by changing the direction of discharge, it is possible to discharge the ball so as to simulate various types of pitching, e.g., not only the fastball pitching to the center of the strike zone, but also pitching to the outside or the inside at a velocity similar to fastball pitching, and breaking ball pitching to the outside or the inside at a slow speed while the path of the ball is changed.

In this baseball game board, since the pitching mechanism rotationally pivotable in the left-right direction around the intermediate portion between the pitching operation section 55 and the pitching section 41 is provided below the top plate 11 and the discharge cover 47 for covering the discharge hole 44 is provided, it is difficult for the batter-side player to predict the direction of the pitching, and the ball 189 can be discharged from below the top plate 11 onto the top plate 11 via the discharge hole 44 by virtue of the inclined sections 121.

When the breaking ball lever 181 is moved rearward by pulling the breaking ball tab 185 rearward, the front end of the movable plate 151 is lowered and the ball 189 is made to drop below the top plate 11 in the swinging range of the bat, whereby the bat can be caused to miss the ball, whereby the players can enjoy battle games between the pitcher and the batter.

By adjusting the front-rear position of the pitching tab 143 so as to adjust the compression strength of the pitching spring 145 with the tip of the finger while the pitching tab 143 is moved in the left-right direction, the pitching direction to the inside or the outside can be changed and the speed of the ball can be increased or decreased, whereby the speed of the fastball and the degree of change in curveball or screwball can be adjusted. As a result, the players can enjoy games by performing various kinds of ball pitching through simple operation of adjusting the position of the pitching tab 143 in the front-rear position and in the left-right direction.

Second Embodiment

Next, a baseball game board according to a second embodiment of the present invention will be described. In the game board body 200 shown in FIG. 7, a discharge cover 247 being movable in the front-rear direction is used instead of the discharge cover 47 of the game board body 10 according to the first embodiment. In this game board body 200, in the case that the discharge cover 247 is positioned at its retreated end, pitching can be performed such that the ball is floated in the air and bounces in the area between the pitching section 41 and the batting section 35. In the case that the discharge cover 247 is positioned at its advanced end, pitching can be performed such that the ball rolls as in the case of the first embodiment.

Hence, the structure for moving the discharge cover 247 in the front-rear direction will be mainly described in the following descriptions, and the members described in the first embodiment are designated by the same reference numerals and their descriptions are omitted or simplified.

Figure 7:
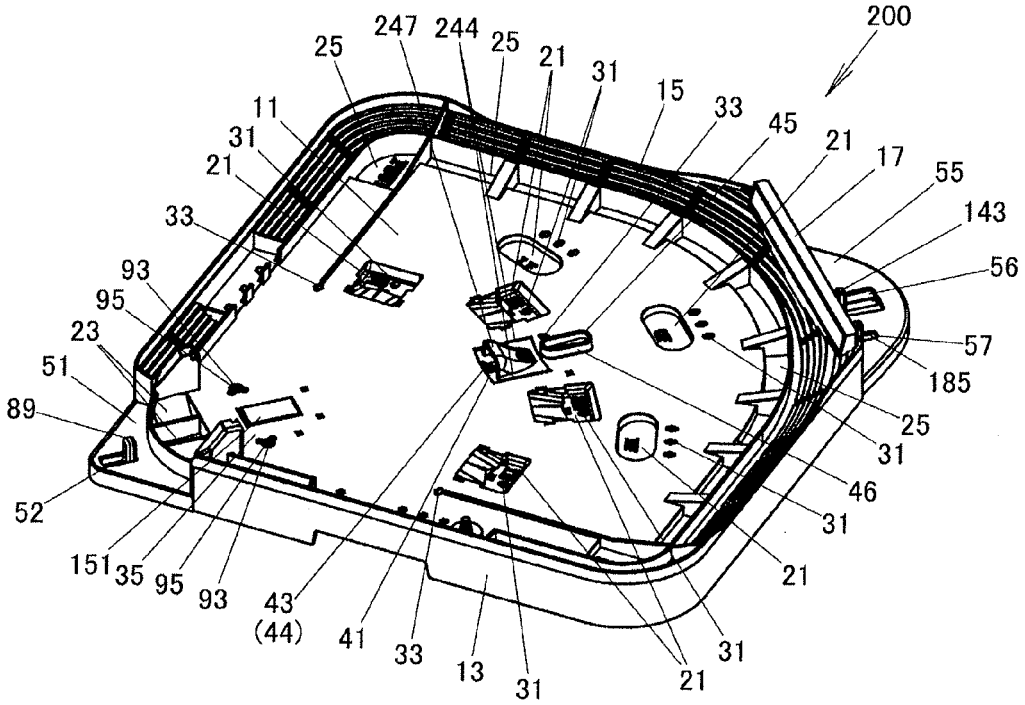
FIG. 7 is a perspective top view showing a baseball game board according to a second embodiment of the present invention.

In FIG. 7, the discharge cover 247 is supported by two left and right edge sections 244 being long in the front-rear direction in the discharge hole 44 so as to be movable in the front-rear direction. More specifically, step sections each having an L-shape in the vertical cross-sectional view and having a flat section in the upward direction are formed so as to be extended long in the front-rear direction at the edge sections 244, and the lower surfaces of the two left and right end edges of the discharge cover 247 are supported so as to be slidable along the flat sections of these step sections.

Figure 8:
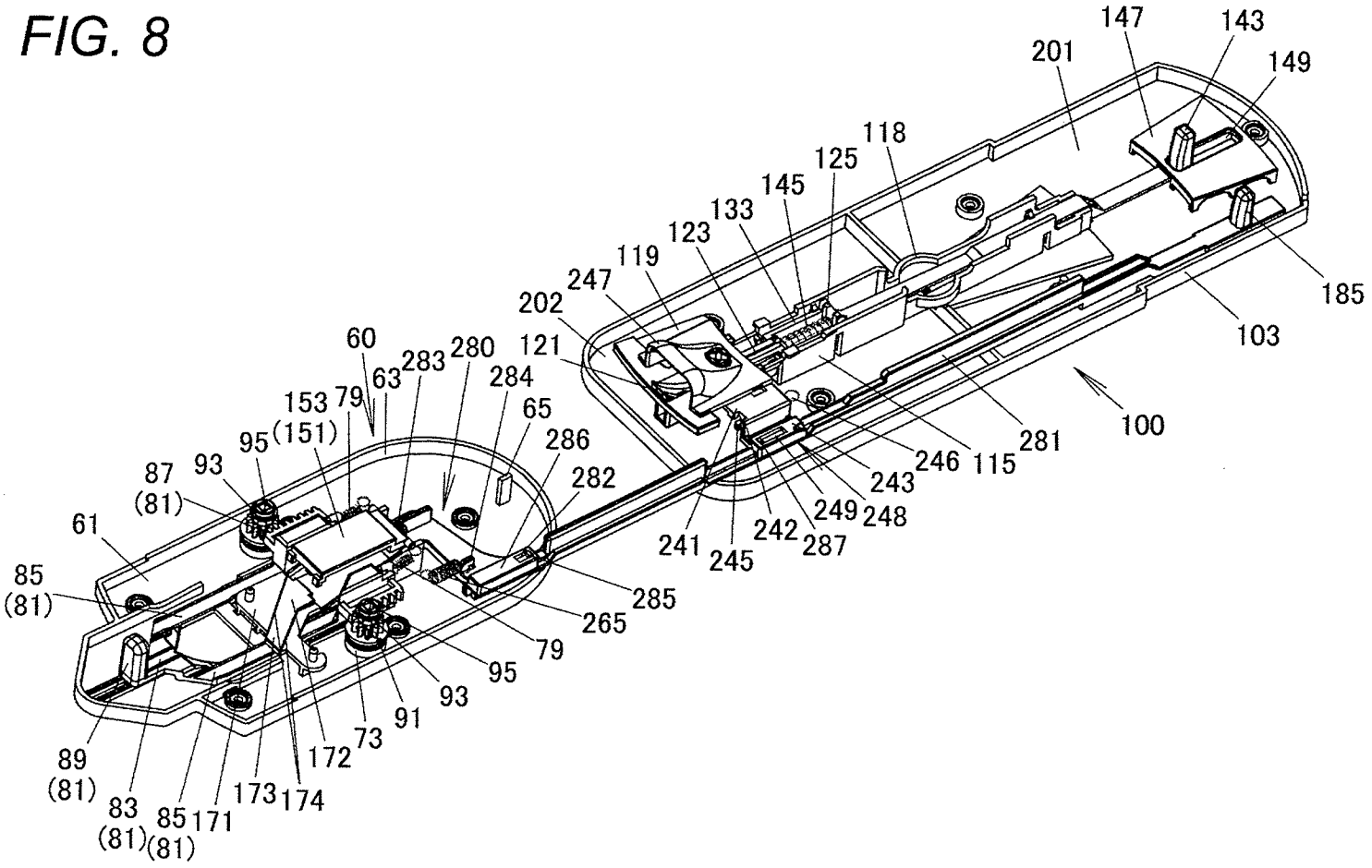
FIG. 8 is a view showing the batting mechanism and the pitching mechanism of the baseball game board according to the second embodiment of the present invention, in which the position of the breaking ball lever is at its default position.
Figure 9:
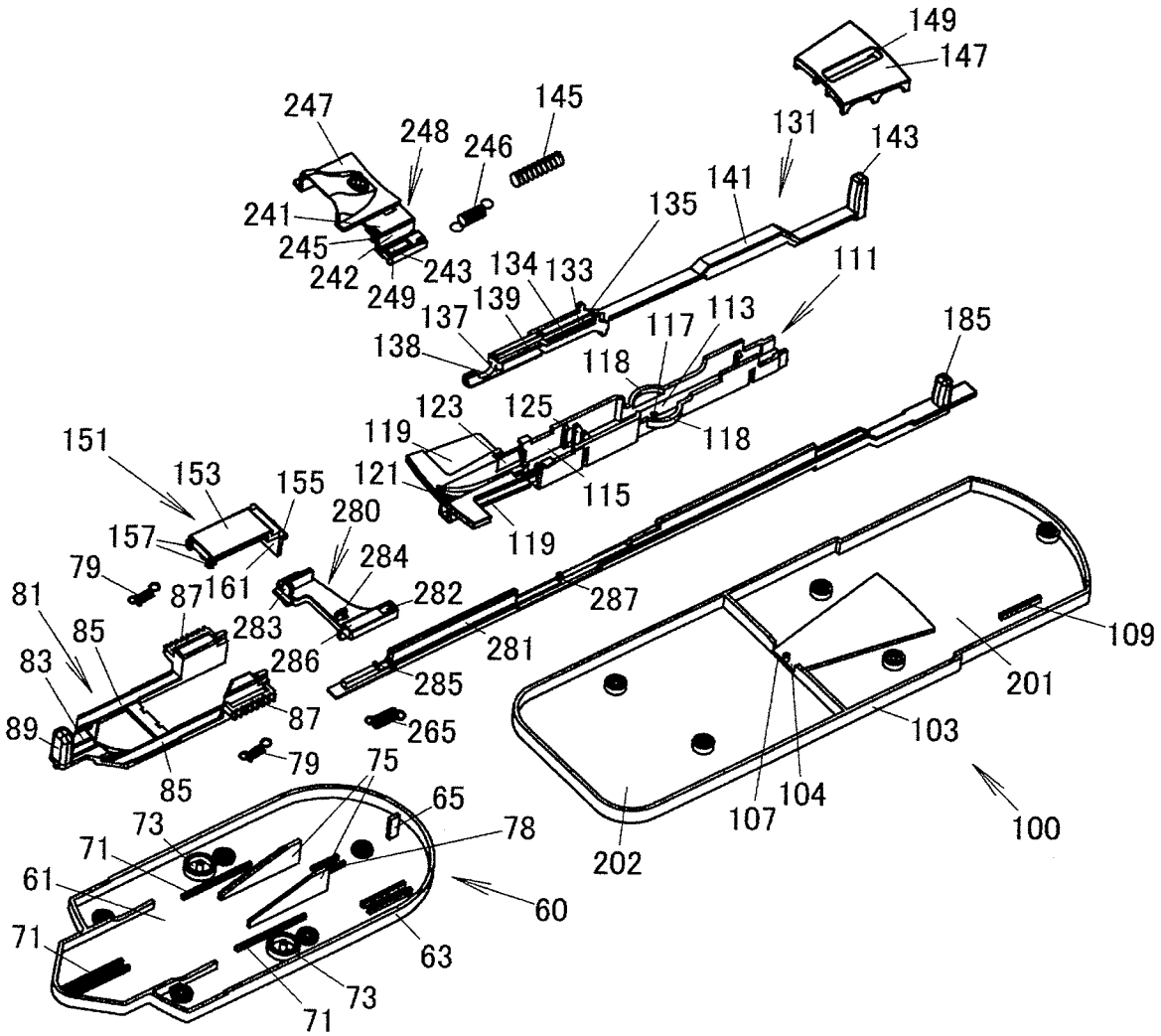
FIG. 9 is an exploded view showing the batting mechanism and the pitching mechanism of the baseball game board according to the second embodiment of the present invention.

As shown in FIGS. 8 and 9, in the discharge cover 247, a connection section 248 protruding leftward from the left side of the base section thereof is formed. The connection section 248 is formed of a plate-shaped horizontal plate 241 protruding leftward from the left side of the base section of the discharge cover 247, a vertical plate 242 extending downward in the vertical direction from the left side of this horizontal plate 241, and a connection block 243 provided on the left side of this vertical plate 242.

In the connection block 243, a slide hole 249 having a rectangular shape being long in the front-rear direction is formed. A slide protrusion 287, protruding upward from the position slightly in front of the center of a breaking ball lever 281 formed into an elongated rod shape, is slidably engaged with this slide hole 249. Hence, the discharge cover 247 is connected to the breaking ball lever 281 so as to be movable in the front-rear direction relatively with respect to the breaking ball lever 281 by the front-rear length of the slide hole 249.

In addition, ring-shaped engagement sections are formed at both ends of a discharge cover spring 246. One end of the engagement sections at both ends of the discharge cover spring 246 is engaged with the engagement section, not shown, located on the lower surface of the top plate 11 and formed behind the connection section 248, and the other end of the engagement sections at both ends thereof is engaged with the engagement section 245 formed on the lower surface of the horizontal plate 241 in the vicinity of the front end of the horizontal plate 241 of the connection section 248. Hence, the discharge cover 247 is urged rearward.

On the other hand, a pressing member 280 is connected to the front end portion of the breaking ball lever 281. The pressing member 280 is formed into a substantially flat plate shape. The right front end portion of the pressing member 280 serves as a pressing section 283 and is formed so as to be able to make contact with the rear surface of the hanging section 161 of the movable plate 151.

The left side section of the pressing member 280 is provided with a connection block 286. In the connection block 286, a rectangular slide hole 282 being long in the front-rear direction is open. A slide protrusion 285 protruding upward in the vicinity of the front end portion of the breaking ball lever 281 is slidably engaged with this slide hole 282. Hence, the pressing member 280 is made movable in the front-rear direction relatively with respect to the breaking ball lever 281 by the front-rear length of the slide hole 282.

In addition, ring-shaped engagement sections are formed at both ends of a pressing member spring 265. One end of the ring-shaped engagement sections of the spring is engaged with the engagement section, not shown, located on the lower surface of the top plate 11 and formed in front of the pressing member 280, and the other end of the ring-shaped engagement sections is engaged with the engagement section 284 provided on the upper surface of the pressing member 280. Hence, the pressing member 280 is urged forward.

In the state shown in FIG. 8, the discharge cover spring 246 and the pressing member spring 265 have their natural lengths. Hence, the front-rear positions of the breaking ball lever 281, the discharge cover 247 and the pressing member 280 being in the state shown in FIG. 8 are their default positions. In this default state, the slide protrusion 287 of the breaking ball lever 281 makes contact with the front end of the slide hole 249 in the connection section 248 of the discharge cover 247, and the slide protrusion 285 of the breaking ball lever 281 makes contact with the rear end of the slide hole 282 of the pressing member 280. At this time, the discharge cover 247 is positioned at its retreated end, and the front upper portion at the inclined sections 121 is open. Furthermore, the pressing member 280 is positioned at its advanced end, and the pressing section 283 makes contact with the rear surface of the hanging section 161 of the movable plate 151.

When pitching operation is performed by pulling the pitching tab 143 rearward in the state shown in FIG. 8, since the front upper portion at the inclined sections 121 is open, the ball having been raised along the inclined sections 121 is directly delivered into the air from the discharge hole 44 without making contact with the inner surfaces of the discharge cover 247, whereby the pitched ball bounces in the area between the pitching section 41 and the batting section 35.

Figure 10:
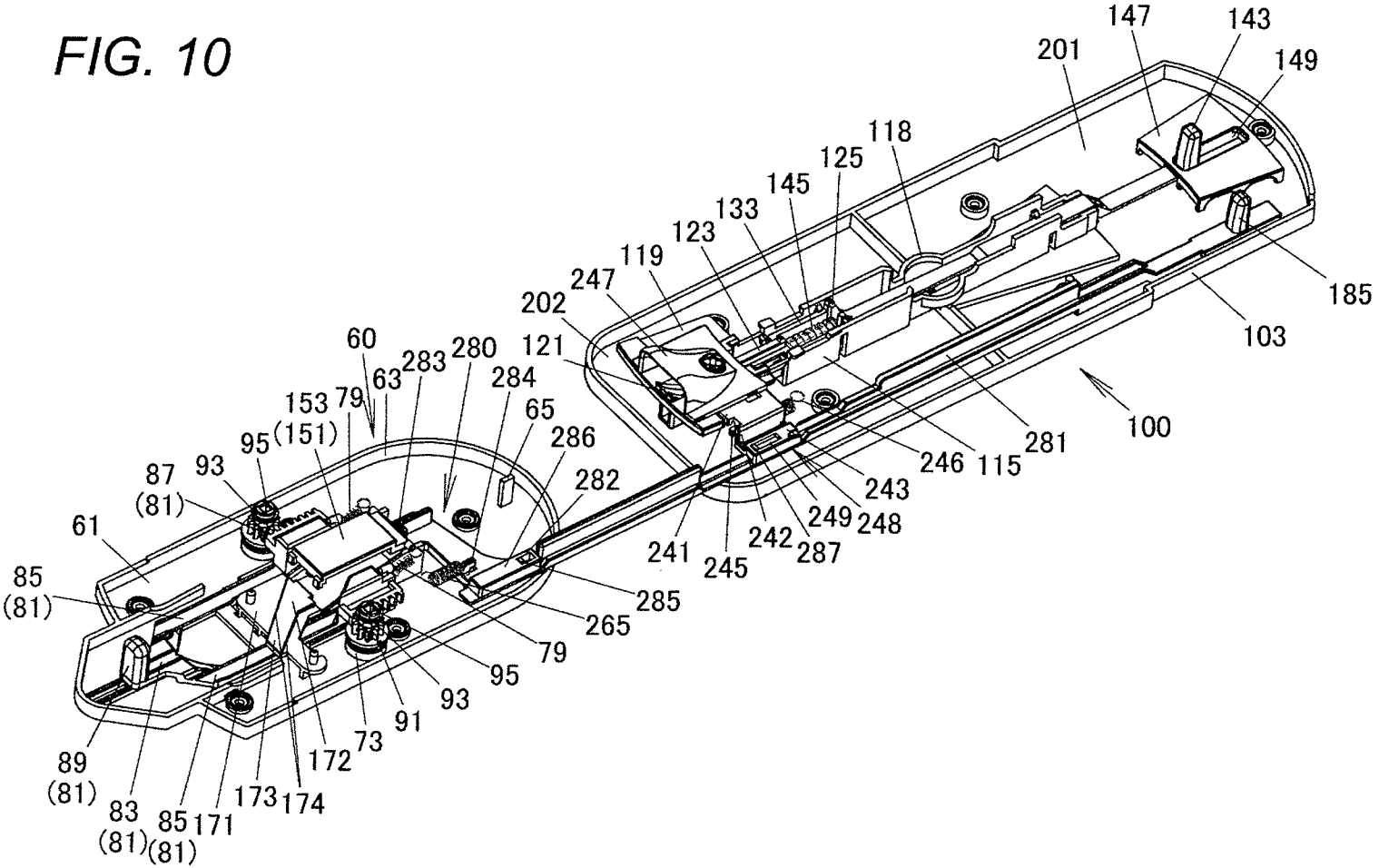
FIG. 10 is a view showing the batting mechanism and the pitching mechanism of the baseball game board according to the second embodiment of the present invention, in which the position of the breaking ball lever having been moved forward.

Next, when the breaking ball tab 185 of the breaking ball lever 281 is moved forward from the default state shown in FIG. 8, the state shown in FIG. 10 is obtained. At this time, since the slide protrusion 287 makes contact with the front end of the slide hole 249 at the default position, the discharge cover 247 is moved forward together with the breaking ball lever 281.

Furthermore, since the slide protrusion 285 is positioned at the rear end of the slide hole 282 at the default position, the pressing member 280 is not moved even when the breaking ball lever 281 is moved forward. Then, the breaking ball lever 281 is moved forward until the slide protrusion 285 makes contact with the front end of the slide hole 282.

At this time, the front upper portion at the inclined sections 121 is covered with the discharge cover 247. Hence, when pitching operation is performed in the state shown in FIG. 10, the ball having been raised along the inclined sections 121 is delivered from the discharge hole 44 and makes contact with the inner surface of the discharge cover 247, whereby pitching is performed such that the ball rolls along the top plate 11.

Figure 11:
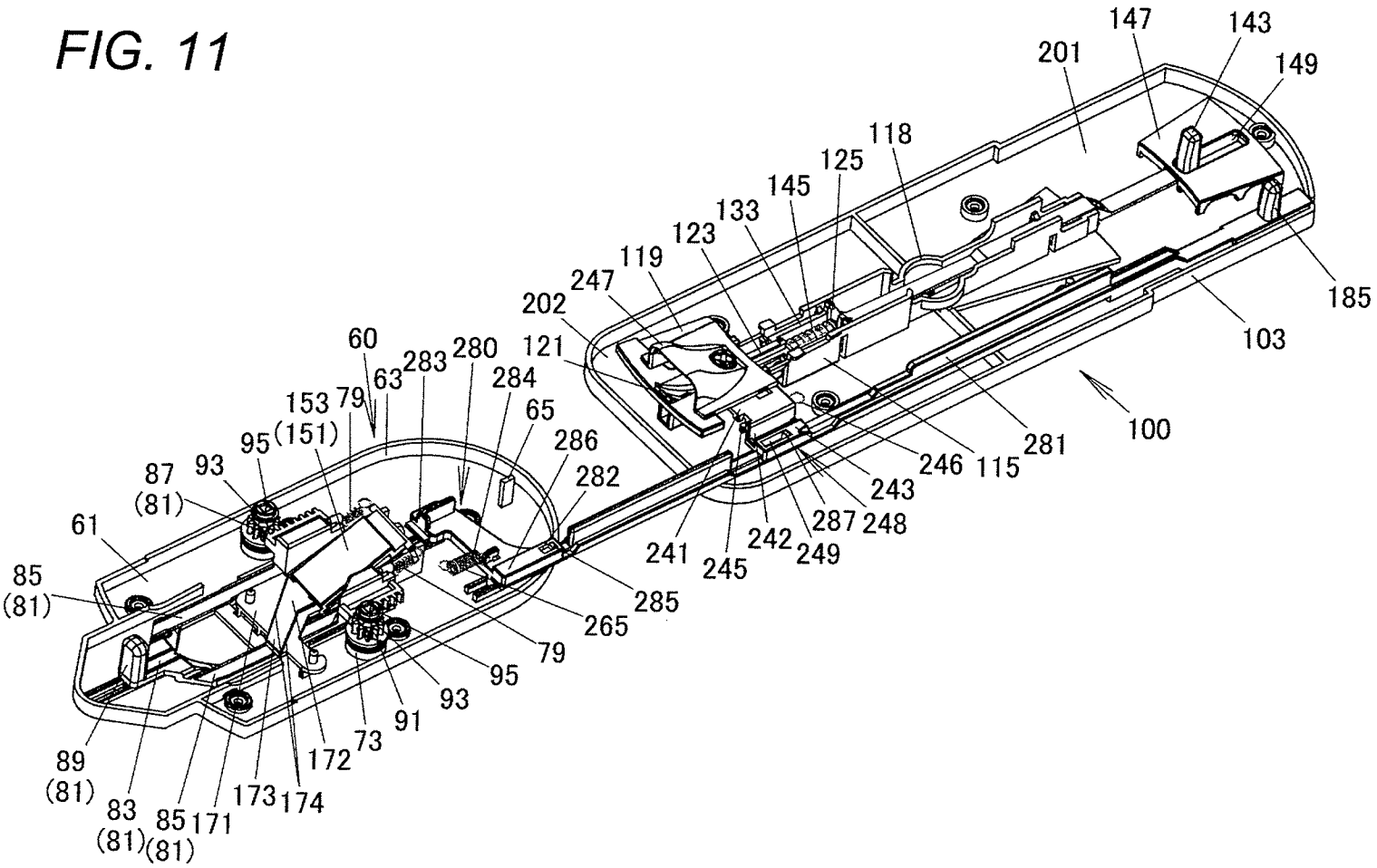
FIG. 11 is a view showing the batting mechanism and the pitching mechanism of the baseball game board according to the second embodiment of the present invention, in which the position of the breaking ball lever having been moved rearward.

Next, when the breaking ball tab 185 of the breaking ball lever 281 is moved rearward from the default state shown in FIG. 8, the state shown in FIG. 11 is obtained. At this time, since the slide protrusion 287 makes contact with the front end of the slide hole 249 at the default position, the discharge cover 247 is not moved rearward together with the breaking ball lever 281. Then, the breaking ball lever 281 is moved until the slide protrusion 287 makes contact with the rear end of the slide hole 249 away from the front end thereof.

Moreover, since the slide protrusion 285 of the breaking ball lever 281 makes contact with the rear end of the slide hole 282 at the default position, the pressing member 280 is moved rearward together with the breaking ball lever 281. Then, the pressing section 283 of the pressing member 280 is moved away from the rear surface of the hanging section 161 of the movable plate 151, and the flat plate section 153 of the movable plate 151 is moved downward by its own weight.

At this time, the front upper portion at the inclined sections 121 is open. Hence, when pitching operation is performed in the state shown in FIG. 11, the ball having been raised along the inclined sections 121 is directly delivered into the air from the discharge hole 44, whereby the pitched ball bounces in the area between the pitching section 41 and the batting section 35. Then, since the flat plate section 153 of the movable plate 151 is lowered downward, the ball discharged by the pitching operation drops below the top plate 11 at the batting section 35.

In this way, by moving the discharge cover 247 in the front-rear direction by operating the breaking ball lever 281, ball pitching can be changed such that the ball to be discharged from the pitching section 41 is discharged into the air or discharged so as to roll on the top plate 11, whereby pitching being richer in variety than in the first embodiment can be performed.

In the case that the ball is discharged from the pitching section 41 so as to roll along the top plate 11 and the ball is made to drop below the top plate 11 by the movable plate 151, the breaking ball tab 185 is moved forward once, and the ball is discharged by operating the pitching tab 143, and then the breaking ball tab 185 is moved rearward immediately after the discharge to lower the flat plate section 153 of the movable plate 151 downward, whereby the ball can be made to drop below the top plate 11.

In addition, although the structure composed of components, such as the pressing member 280, for operating the movable plate 151 is provided at the tip end of the breaking ball lever 281 in this embodiment, the present invention is not limited to this configuration. For example, it is possible that the breaking ball lever 281 is fixedly connected only to the discharge cover 247 and the members for operating the pressing member 280 to be used to move the movable plate 151 are provided separately, or it is also possible that the ball is not made to drop from the top plate 11 without providing the movable plate 151.

With the above-mentioned embodiments according to the present invention, it is possible to provide baseball game boards having the following aspects.

A baseball game board according to a first aspect is a baseball game board having a top plate equipped with a field section and a seat section on a game board body simulating a baseball stadium; a pitching section in the vicinity of the center of the top plate serving as the field section; a batting section at the front portion of the top plate serving as the field section; a batting operation section at the front outward portion of the top plate; a pitching operation section at the rear outward portion of the top plate; and a pitching lever having the length from the inside of the pitching operation section to the position below the pitching section, wherein the pitching lever is rotatable in the left-right direction in parallel with the top plate around the intermediate portion between the pitching operation section and the pitching section and is equipped, at the end thereof, with a ball holding section for receiving the ball dropping from a ball container section on the top plate, and when the pitching lever is moved forward abruptly by a pitching spring, the ball held in the ball holding section and positioned below the top plate is delivered from the discharge hole provided in the top plate to the upper surface of the top plate, thereby being discharged toward the batting section.

With this configuration, since the discharge direction of the ball is changed in the left-right direction, not only fastball pitching to the center of the strike zone but also fastball pitching to the outside or the inside can be performed, whereby the variation width of the pitching can be widened and the players can enjoy more interesting baseball games.

A baseball game board according to a second aspect is the baseball game board according to the first aspect, further having a magnet provided on the back surface of the top plate at the intermediate position between the pitching section and the batting section.

With this configuration, the change in the pitching path due to the influence of the magnet depending on the speed of the ball can be added to the pitching to the inside or the outside and the players can enjoy much more interesting baseball games.

A baseball game board according to a third aspect further has a breaking ball lever formed into an elongated rod shape, located below the top plate and movable in the front-rear direction, wherein the pitching section is equipped with a discharge cover being used to cover the discharge hole, supported by the peripheral edges of the discharge hole so as to be movable in the front-rear direction and connected to the breaking ball lever.

With this configuration, since the upper portion of the discharge hole from which balls are discharged can be opened or covered by moving the discharge cover in the front-rear direction, pitching can be performed such that the ball is floated in the air in the case that the upper portion of the discharge hole is opened, and pitching can also be performed such that the ball rolls along the top plate in the case that the upper portion of the discharge hole is covered. Hence, the players can enjoy far more interesting baseball games.

Although the embodiments according to the present invention have been described above, the present invention is not limited to the above-mentioned embodiments, but can be modified variously without departing from the scope of the invention.

For example, although the magnet 68 is fixed to the upper end of the magnet holding section 65 in the above-mentioned embodiment, the magnet 68 can be moved in the left-right direction. An L-shaped link member is provided at the upper end of the magnet holding section 65, and this link member is equipped with an arm extending forward from the magnet holding section 65 and an arm extending sideways from the magnet holding section 65 and is rotatable by using the magnet holding section 65 as its rotation axis. The magnet 68 is fixed to the tip end of the arm extending forward from the magnet holding section 65, and the tip end of the arm extending sideways from the magnet holding section 65 is engaged with the front end of a rod-shaped operation lever. This operation lever is placed parallel to the breaking ball lever 181 and the rear end of the operation lever is accommodated in the pitching operation section cover 100, and the tip end of the operation tab extending upward at the rear end of the operation lever protrudes to the upper surface of the pitching operation section 55. The magnet 68 is moved in the left-right direction in the area between the batting section 35 and the pitching section 41 by operating the operation tab in the front-rear direction.

Hence, with this configuration, much more kinds of breaking balls can be discharged than in the case that the magnet 68 is fixed, and the players can enjoy much more interesting baseball games.

According to embodiments of the present invention, pitching simulating fastball pitching to the outside or the inside can be made, and the width of the change in pitching is increased, whereby embodiments of the present invention can provide a baseball game board on which the players play baseball games enjoyably while imagining actual pitching.

What is claimed is:

1. A baseball game board comprising:

a game board body simulating a baseball stadium;

a top plate provided on the game board body and comprising a field section;

a pitching section provided in a vicinity of a center of the top plate and comprising a ball container section and a discharge hole;

a batting section provided in a front portion of the top plate;

a batting operation section provided in a front outward portion of the top plate;

a pitching operation section provided in a rear outward portion of the top plate;

a pitching lever extending from an inside of the pitching operation section to the pitching section and movable in forward and rearward directions; and a breaking ball lever having an elongated rod shape, provided below the top plate, and movable in the front-rear direction, wherein the pitching lever is disposed below the top plate, is rotatable in a left-right direction in parallel with the top plate around a position between the pitching operation section and the pitching section, and comprises a ball holding section provided at a front end of the pitching lever for receiving a ball dropping from the ball container section, wherein when the pitching lever is moved forward, the ball held in the ball holding section and positioned below the top plate is delivered from the discharge hole to an upper surface of the top plate, thereby being discharged toward the batting section, and wherein the pitching section comprises a discharge cover which covers the discharge hole, which is supported by peripheral edges of the discharge hole so as to be movable in the front-rear direction, and which is connected to the breaking ball lever.

2. A baseball game board comprising:

a game board body simulating a baseball stadium;

a top plate provided on the game board body and comprising a field section;

a pitching section provided in a vicinity of a center of the top plate and comprising a ball container section and a discharge hole;

a batting section provided in a front portion of the top plate;

a batting operation section provided in a front outward portion of the top plate;

a pitching operation section provided in a rear outward portion of the top plate;

a pitching lever extending from an inside of the pitching operation section to the pitching section and movable in forward and rearward directions;

a magnet provided on a back surface of the top plate at a position between the pitching section and the batting section, and a breaking ball lever having an elongated rod shape, provided below the top plate, and movable in the front-rear direction, wherein the pitching lever is disposed below the top plate, is rotatable in a left-right direction in parallel with the top plate around a position between the pitching operation section and the pitching section, and comprises a ball holding section provided at a front end of the pitching lever for receiving a ball dropping from the ball container section, wherein when the pitching lever is moved forward, the ball held in the ball holding section and positioned below the top plate is delivered from the discharge hole to an upper surface of the top plate, thereby being discharged toward the batting section, and wherein the pitching section comprises a discharge cover which covers the discharge hole, which is supported by peripheral edges of the discharge hole so as to be movable in the front-rear direction, and which is connected to the breaking ball lever.

3. A baseball game board comprising:

a game board body simulating a baseball stadium;

a top plate provided on the game board body; and a pitching section provided on the top plate and comprising a discharge hole through which a ball is discharged, wherein the pitching section comprises a discharge cover which covers the discharge hole, and which is supported by edge sections of the discharge hole so as to be movable in a front-rear direction, wherein when the discharge cover is positioned in the rear direction, the pitching section allows the ball to be delivered in the air without contacting an inner surface of the discharge cover, and wherein when the discharge cover is positioned in the front direction, the pitching section delivers the ball to roll on the top plate by contacting the inner surface of the discharge cover.

4. The baseball game board according to claim 3, further comprising:

a breaking ball lever having an elongated rod shape, provided below the top plate, and movable in the front-rear direction, wherein the discharge cover is connected to the breaking ball lever.

* * * * *